United States Patent [19]

Scheidegger

[11] 4,231,479

[45] Nov. 4, 1980

[54] CLOSURE CAPS ADAPTED FOR DISTRIBUTION IN A CHANNEL

[76] Inventor: Albert Scheidegger, 30 rue Caporal Morange, 69100 Villeurbanne, France

[21] Appl. No.: 26,355

[22] Filed: Apr. 2, 1979

Related U.S. Application Data

[60] Continuation-in-part of Ser. No. 903,919, May 8, 1978, Pat. No. 4,171,736, which is a division of Ser. No. 862,915, Dec. 21, 1977, Pat. No. 4,114,774.

[51] Int. Cl.[3] ..... B65D 41/12

[52] U.S. Cl. ..... 215/250; 215/305

[58] Field of Search ..... 215/250, 254, 256, 305

[56] References Cited

U.S. PATENT DOCUMENTS 1,706,720 3/1929 Wettstein ..... 215/305

FOREIGN PATENT DOCUMENTS 457847 6/1950 Italy ..... 215/305

*Primary Examiner*—Donald F. Norton

*Attorney, Agent, or Firm*—Dennison, Dennison, Meserole & Pollack

[57] ABSTRACT

Tear-off closure caps shaped for distribution at high speed in channels, the caps each comprising two tear-off tongue portions disposed in a flat V-shape in the plane of the rim portion, at the bottom of its skirt portion. The tongue portions have the outer ends slightly bent upwardly, the bends obliging the rim portion of each cap to become engaged under the tongue portions of the cap which precedes it in a distribution channel. The distribution channel includes grooves in the opposed side walls which receive and guide the outer edges of the tongue portions, the outer edges being slightly divergent relative to each other toward their outer ends.

4 Claims, 6 Drawing Figures

CLOSURE CAPS ADAPTED FOR DISTRIBUTION IN A CHANNEL

This is a continuation-in-part of application Ser. No. 903,919, filed May 8, 1978, now U.S. Pat. No. 4,171,736, which is in turn a division of application Ser. No. 862,915, filed Dec. 21, 1977, now U.S. Pat. No. 4,114,774, issued Sept. 19, 1978.

The invention herein relates to a closure cap for a container such as a bottle and to a system for feeding such closure caps at high speed to a station where they are secured to a container.

Before metal closure caps used for closing containers, such as bottles, are crimped onto the neck of the container they are produced by deformation of a blank cut or stamped from a metal strip. Each cap is either produced in a station which is integrated in a container filling plant, or is prefabricated outside of the plant.

In the first case, the cap is received in a suitable orientation at the outlet of the cap producing station and is fed along a passage to the closing station. In the second case, the caps are tipped in a loose state into a device which orients the caps and supplies them to a passage along which they are fed to the closing station.

During the feeding of the caps to the closing station, and also when the caps are introduced into the crimping head, it can happen that the caps become wedged, either by caps siding up onto the preceding caps, or by virtue of defective orientation or due to the provision of a tongue or tab portion on the caps. This results in interruptions in the feed to the crimping head and therefore the operation of closing the containers and in the operation of the bottling plant.

Such interruptions are more frequent when each cap has two tongue or tab portions.

The parent U.S. applications, and related foreign priority application, teach the feasibility of caps which have two tongue portions being distributed at high speed in a channel, even if the caps are produced from a tearable and deformable material such as thin aluminum, provided that the caps are of a particular configuration.

In most cases, the prior caps of the parent applications are produced with flat tongue portions which are disposed in the plane of the rim portion which borders the bottom of the skirt portion of the cap, as shown in the parent applications, the disclosures of which are herein incorporated by reference.

In this arrangement, the portion of the rim portion which appears in the space between the two tongue portions forms, with the inside edges of the two tongue portions, a curvilinear opening which is disposed substantially at a tangent to a circle having a diameter which is equal to the largest diameter of the rim portion of the cap.

When such caps are disposed in line in a channel, the above-mentioned opening makes it possible for each cap to engage deeply between the tongue portions of the preceding cap. The caps thus guide each other, forming a regular chain in the channel.

Moreover, in the prior caps the opposite edges of the tongue portions are substantially parallel and spaced apart by a distance which is substantially equal to the largest diameter of the rim portion and preferably, slightly greater than said diameter.

Now, in order to reduce friction against the side walls of the channels, while also reducing the dangers of the caps becoming jammed when the channel is curved in a horizontal plane, it has been found advantageous to have tongue portions whose opposite edges are very slightly divergent towards their ends. The angle which the two opposite edges make between them is generally on the order of 10°. Thus, because of the position of the tongue portions, there is theoretically no contact between the cap and the side wall of the channel, except at a point on each side of the cap, which point is substantially at the outer end of each tongue portion. The theoretical clearance between the cap and the side walls of the channels is greater at a position in line with the cover portion of the cap, than at a position in line with the ends of the tongue portions.

In a channel in which the caps with flat tongue portions are disposed in line, each cap theoretically bears by way of its skirt portion against the inside edges of the tongue portions of the preceding cap. They retain their initial orientation during their movement.

However, if the tongue portions are strictly in the plane of the rim portion of the cap, the rim portion of the following cap can equally well become engaged above instead of below the tongue portions. When the rim portion engages below the tongue portions, the positioning is as desired. In the opposite case, in which the rim portion engages above the tongue portions, the following cap can bear, by way of the front of its rim portion, against the skirt portion of the preceding cap, between the two tongue portions.

It is then possible to have caps which are at different levels in the channel, some caps resting completely on the bottom of the channel while other caps are in an inclined position, for example with the front resting on the bottom of the channel and with the rear resting by way of its tongue portions on the rim portion of the following cap, while yet other caps may be slightly raised, with their front resting on the tongue portions of the preceding cap and with their rear resting on the rim portion of the following cap. The difference in level between such caps corresponds to the thickness of the wall of the caps.

Now, if the channel must be curved in a vertical plane, if for example it must include a vertical portion followed by a horizontal portion, or vice-versa, it is important for all the caps to be strictly at the same level, so that there is no possibility of the caps jamming each other up. Such jamming, in a curve in a vertical plane, further increases the apparent difference in thickness of the caps in the channel. This problem can be alleviated by inclining the tongue portions downwardly, as shown in FIG. 7 or FIG. 11 of the parent applications. However, this solution makes it necessary to provide a channel which has a bottom with a central rib and two longitudinal grooves, one on each side of the rib.

A better solution has been found. According to the present invention in one aspect there is provided a method for feeding caps at high speed along a channel, each cap having a body portion, a rim portion and two tongue portions forming a V-shaped space in the plane of the rim portion, the outer side edges of the tongue portions being spaced apart by a distance which is substantially equal to the largest diameter of the cap, said method comprising displacing each cap with its two tongue portions to the rear and substantially parallel to their axis of symmetry and transversely guiding each cap by contact between the outer side edges of its tongue portions with the side walls of the channel, the distance between said walls being substantially equal, apart from a clearance, to the distance between the outer side edges of said tongue portions, said caps being positioned longitudinally with respect to each other by having the front part of their skirt portion abutting against the facing edges of the V-shaped space formed by the two tongue portions of the preceding cap, the end of each tongue portion being folded upwardly, said fold on each tongue portion causing each rim portion to be engaged under the tongues of the preceding cap. In this way all the caps are in a position in which they are slightly inclined forwardly.

In order to guide the caps more certainly in the twisting paths comprising vertical portions or curves in several planes, closed channels are used, which have a cross-section equal to that of the caps except for the clearance required.

In each cap the distance H between the most remote portions of the outer side edges of the two tongue portions is at least equal to the largest diameter of the skirt portion. In the case of tongue portions whose opposite edges diverge towards the ends, this distance H is even slightly greater than the diameter of the rim portion. In order to improve the guiding of the caps, it will be advantageous to use channels of non-rectangular cross-section but whose cross-section is in the shape of an inverted T with short wings. These are, as it were, channels of rectangular cross-section, in which grooves have been formed at the bottom of each of the side walls. The width L of the channel at its base at the level of the grooves is equal, apart from the necessary clearance, to the largest width H of the caps. At the upper part, the width L is somewhat greater than the diameter of the skirt portion of the caps. Thus, the opposite edges of the tongue portions engage in the grooves, while the skirt portion is guided by the upper part of the channel.

According to the present invention in another aspect there is provided a closure cap for a container comprising a body portion having a rim and two tongue portions forming between them a substantially V-shaped space and disposed in the plane of the rim portion, the inside edges of the two tongue portions forming, with the edge of the rim portion in the space between the two tongue portions, a curvilinear opening which is substantially at a tangent to a circle having a diameter equal to the diameter of the rim portion, the ends of the two tongue portions being curved upwardly along two symmetrical folds.

The distribution system and the form of cap will be better appreciated from the following description of a particular embodiment, and from study of the accompanying drawing.

Figure 1:
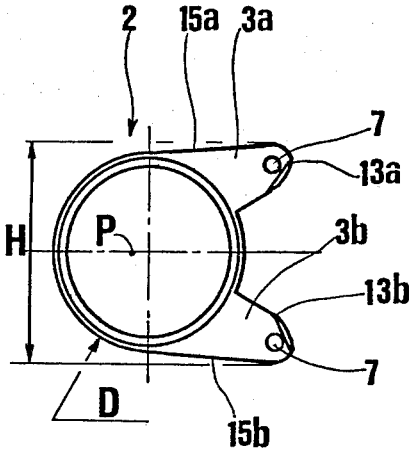
FIG. 1 shows a plan view from above of the improved cap.
Figure 2:
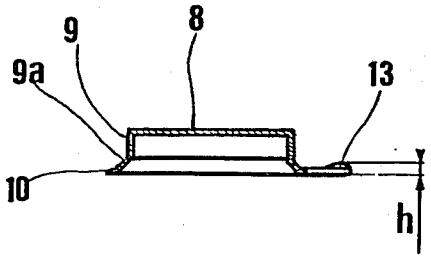
FIG. 2 shows a longitudinal section of the same cap.
Figure 3:
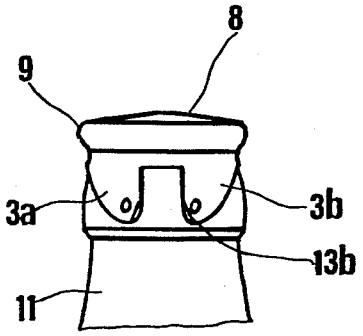
FIG. 3 shows an elevational view of the same cap after it has been set in position and crimped on a bottle neck.

As shown in FIG. 1, the cap 2 comprises two tear-off tongue portions 3*a* and 3*b* which form a V-shaped arrangement, the tongue portions being disposed symmetrically with respect to an axial plane P of the cap 2.

Perforations 7 are provided at the ends of the tongue portions 3*a* and 3*b*. The cap 2 further comprises a top 8 and a skirt portion 9 which is flared outwardly at 9*a* and which terminates in a rim portion 10. The tongue portions 3*a* and 3*b* are disposed substantially in the plane of the rim portion 10.

Unlike the flat tongue portions 3*a* and 3*b* of the parent applications, the tongue portions are curved upwardly at their ends, along two symmetrical folds 13*a* and 13*b* to form upwardly curved portions 13.

Figure 4:
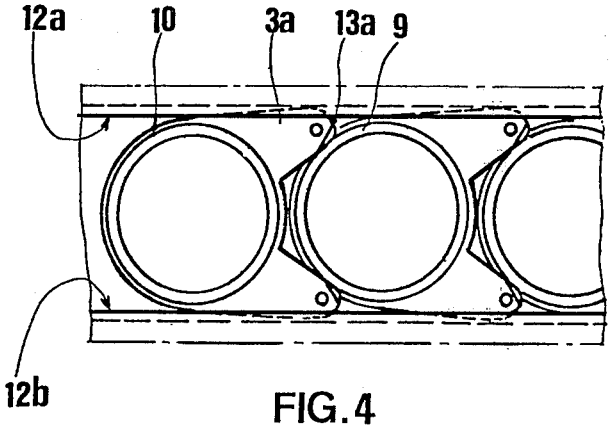
FIG. 4 is a plan view of a distribution channel in which caps are arranged in line.
Figure 6:
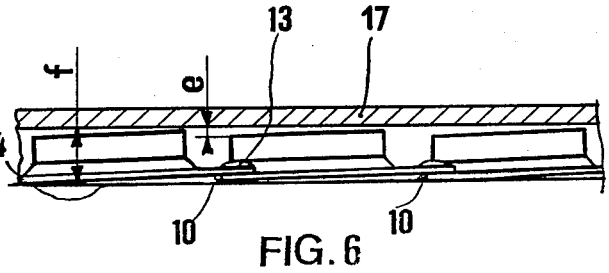
FIG. 6 is a view in longitudinal section of the channel-received caps of FIG. 4.

It will be seen from FIGS. 4 and 6 that the folds 13*a* and 13*b* oblige the front of each rim portion 10 to become engaged under the rear of the tongue portions 3*a* and 3*b* of the preceding cap. The caps either rest flat on the bottom 14 of the channel or, as shown in FIG. 6 are slightly inclined in a forward direction. The front of the rim portions 10 rests on the bottom 14 of the channel, while the rear of the tongue portions 3*a* and 3*b* either rests on the same channel bottom 14 or on the rim portion 10 of the following cap 2, this occurring when the caps are pushed against each other, for example in an axially inclined part of the channel. It is not possible for cap 2 to be jammed up by being caught between the preceding cap and the following cap. This is particularly important in parts of the channel which are curved, where a cap could be markedly raised with respect to the two caps which are disposed on respective sides thereof, the different caps being disposed along the chords of the curved part of the channel.

The cap 2 shown herein is made of a sheet of aluminum which is 0.16 mm in thickness. The height of the cover portion of the cap is 7 mm, while the diameter D of the rim portion 10 is 30 mm. The distance H corresponding to the maximum width of the tongue portions 3*a* and 3*b* at the rear thereof is 33 mm, while the height h of the portions 13 at folds 13*a* and 13*b* is of the order of 2 mm. The height f of the channel is 8 mm.

Figure 5:
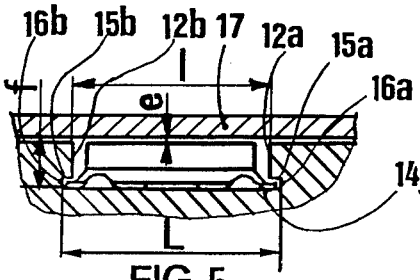
FIG. 5 is a view in section through a vertical transverse plane of the same channel, the channel illustrated here being a closed channel.

It will be noted that the opposite edges 15*a* and 15*b* of the tongue portions 3*a* and 3*b* are not precisely parallel but diverge slightly towards the rear. This reduces the friction of the tongue portions against the side walls 12*a* and 12*b* of the channel. This also makes it possible for two grooves 16*a* and 16*b* to be provided at the bottom of the two side walls 12*a* and 12*b*, the ends of the opposite edges of the tongue portions engaging into the grooves 16*a* and 16*b*, as shown in FIG. 5. These grooves provide for perfect guiding of the caps, even in the vertical parts of the channel. Thus, the width L of the lower part of the channel at the level of the grooves 16*a* and 16*b* is equal, apart from clearance, to the maximum distance H between the opposite edges of the tongue portions 3*a* and 3*b*, while the width of the upper part of the channel is slightly reduced, while however remaining slightly greater than the diameter D of the skirt portions 9 of the caps.

As will be readily understood, when studying FIG. 5 or FIG. 6, to assure that the front of a rim portion 10 cannot under any circumstances engage above the rear of the tongue portions 3*a* and 3*b* of the preceding cap, the folds 13*a* and 13*b* are provided with a height h greater than the vertical clearance e of the cap 2 in its channel, that is to say $h > e$.

Thus, even if the cover portion of the second cap is laid against the roof 17 of the channel, the front of its rim portion 10 remains engaged below the upper part of the folds 13*a* 13*b*.

I claim:

1. A closure cap comprising an annular depending skirt portion having a peripheral rim portion about the bottom thereof, two spaced tongue portions extending rearwardly from and disposed in the plane of the rim portion and forming a V-shaped space therebetween, the inside edges of the two tongue portions forming, with the edge of the rim portion in the space between the two tongue portions, a curvilinear opening wherein the inside edges of the tongue portions are substantially at a tangent to a circle having a diameter equal to the diameter of the skirt portion, while the opposite edges of the tongue portions are generally parallel and spaced apart by a distance generally equal to the diameter of the rim portion, the outer ends of the two tongue portions being curved upwardly along two symmetrical folds to insure engagement of the rim portion of an adjacent cap under the tongue portions.

2. A cap according to claim 1 wherein the opposite edges of the two tongue portions are divergent rearwardly.

3. A cap as claimed in claim 2, in which the outer side edges form between them an angle in the region of 10°.

4. A cap as claimed in any one of claims 1 or 2 or 3, particularly adapted for distribution in a closed top channel and wherein the height of the folds is greater than the vertical clearance of the cap in its channel.

* * * * *